United States Patent [19]

Irvine

[11] Patent Number: 4,908,919

[45] Date of Patent: Mar. 20, 1990

[54] PRODUCTION OF TEXTURED YARN

[75] Inventor: Albert Irvine, Belfast, Northern Ireland

[73] Assignee: James Mackie & Sons Limited, Belfast, Northern Ireland

[21] Appl. No.: 141,266

[22] Filed: Jan. 6, 1988

[30] Foreign Application Priority Data

Jan. 16, 1987 [GB] United Kingdom ..... 8701046

[51] Int. Cl.[4] ..... D02G 1/14; D02G 1/20

[52] U.S. Cl. ..... 28/250; 28/256

[58] Field of Search ..... 28/255, 256, 257, 249, 28/250, 251, 221

[56] References Cited

U.S. PATENT DOCUMENTS

| | | | |
|---|---|---|---|
| 3,296,680 | 1/1967 | Iwnicki et al. | 28/250 |
| 3,311,961 | 4/1967 | Iwnicki et al. | 28/250 |
| 3,961,402 | 6/1976 | Ferrier et al. | 28/250 |
| 4,012,816 | 3/1977 | Hatcher | 28/255 X |
| 4,135,511 | 1/1979 | Nikkel | 28/250 X |
| 4,270,252 | 6/1981 | Harrison et al. | 28/250 |
| 4,337,557 | 7/1982 | McDonald et al. | 28/250 |
| 4,404,718 | 9/1983 | Tajiri et al. | 28/250 X |
| 4,608,736 | 9/1986 | Tajiri et al. | 28/250 X |

FOREIGN PATENT DOCUMENTS

| | | | |
|---|---|---|---|
| 214159 | 10/1984 | German Democratic Rep. | 28/250 |
| 1342484 | 1/1974 | United Kingdom . | |
| 1422949 | 1/1976 | United Kingdom . | |

*Primary Examiner*—Werner H. Schroeder
*Attorney, Agent, or Firm*—Larson and Taylor

[57] ABSTRACT

Yarn 1 fron an extruder is stretched by heated rollers (3,5) and passes to a texturizer unit 2 where it is plasticized and crimped, leaving in the form of a crimp plug along a stack (8). The yarn is heated in the unit (2) by air passing along a pipe (7) and heated by a base heating element (9) in conjunction with a booster element (11). The plug of crimped yarn (6) passes to the surface of a rotating cooling drum (4), around which it makes a number of turns before crimped yarn (1') is withdrawn from the leading end of the plug at (6'). The plug length is monitored by a sensor unit comprising a light source (16) which directs light through holes 10 in the drum onto a receiver unit (14) including three diodes A, B and C. When the plug end (6') is at the datum position, the diode A is covered, the diode (C) is uncovered and the plug end flutters backwards and forwards over the diode (B). This generates control signals which adjust the degree of crimp so as to maintain the plug end at or close to the datum position. After leaving the drum (4) the crimped yarn (1) passes to a take-off roller (4) via a further roller (22) and an inter-mingling jet (21) and then passes to a winder (26). The novelty lies in the inclusion of a spring loaded tension guide (24) which moves up and down with the tension in the yarn and also serves as a detector for a yarn break. In this event, the guide (24) moves upwardly to a position to provide a signal from an electrical unit which replaces the signal from the light sensing unit (14,16) so as to control the unit (2) to keep the degree of crimp either at the position it was immediately before the yarn break or to move it towards the datum position if, at the time of the break, it was spaced from that position.

2 Claims, 5 Drawing Sheets

PRODUCTION OF TEXTURED YARN

FIELD OF THE INVENTION

This invention relates to the production of crimp textured yarn such as nylon, polypropylene and polyester.

BACKGROUND OF THE INVENTION

Methods and apparatus for texturising such extruded yarns are well known and it is desirable to maintain as constant a bulk level of the crimp-textured yarn as possible since variation can result in shading of the colour of the finished product, such as carpet or fabric. One particular method of fluid jet texturising of a yarn and controlling the crimp is described in British patent No. 1,422,949 in which the crimped yarn is formed into an elongated plug, the position of the leading end of which is monitored about a predetermined datum position, variations therefrom indicating changes in the bulk level of the crimped yarn. If the plug is too long it indicates that there is insufficient bulk and therefore the temperature of the jet, i.e. the temperature of the fluid (e.g. air) in the jet, is increased so as to increase the plasticity of the yarn and hence make it crimp more readily. Conversely, if the plug is too short it indicates the requirement for a reduction in the bulk and hence the temperature of the jet is decreased. Various alternative sensing arrangements are described in the above patent in which the end of the plug is sensed in the stack following the crimp chamber or on a crimping or cooling drum.

Other parameters may be adjusted to give a similar result. These are, in particular, the velocity and/or pressure of the fluid in the jet and the temperature of the rollers upstream of the jet which impart an initial stretch to the yarn, or heat it further subsequent to stretching, or the temperature of a plate or plates which may also be used for heating the yarn.

It will be understood from the foregoing that the position of the leading end of the crimp plug in relation to the datum position is the dominant factor in maintaining a substantially constant bulk level of the crimp-textured yarn, that is to say, a predetermined degree of bulk. However, if a break in the yarn occurs, especially in the length of yarn between the crimp plug and the winder, the plug length will continue to grow and the leading end of the plug will pass beyond the datum position since yarn will not then be actively pulled away. Assuming that the parameter being controlled is the jet temperature, this will result in increasing power to the heating element for the jet. Therefore when the yarn is subsequently threaded up again and winding re-commences, it may take an appreciable time for the end of the plug to re-stabilise at the sensor position, leading to production of yarn with incorrect bulk level. Since the yarn speed may be in the region of 1500 metres/minute, a very considerable length of yarn would be produced with much too high a bulk level and if allowed to be wound onto the package would result in colouring problems with the finished product. To avoid this, the normal practice is to use an aspirator gun which aspirates the faulty yarn into a reservoir for subsequent disposal to waste. When threading up again, the operator establishes the plug end in the vicinity of the datum position and operation can then resume, the sensor control restoring the leading end of the plug to the correct position within a relatively short space of time.

Conversely, if a yarn break occurs upstream of the texturising jet, the yarn will be withdrawn from the downstream end of the plug while none will be added to the upstream end, i.e. from the texturising jet, hence resulting in an incorrect signal from the sensor that the crimp is too great and resulting in reduction of power to the jet heating element to its minimum. When rethreading, it may again take some time for the leading end of the crimp plug to re-stabilise at its datum position, again resulting in the production of inconsistently bulked yarn, this time with too little crimp. This same condition will apply when an aspirator gun is used for sucking away a broken end, if in so doing the leading end of the plug falls behind the datum position.

SUMMARY OF THE INVENTION

According to the present invention, in addition to monitoring the position of the leading end of the crimp plug to provide a signal for controlling at least one of the parameters affecting the degree of bulk applied to the yarn, the passage of yarn to the winder is also monitored to provide a second signal in response to a predetermined change in the state of the yarn, the second signal either replacing or arresting the first signal, so as to keep the said parameter or parameters at a value related to the predetermined degree of bulk. As a result, any yarn produced in the interval between the break and the subsequent threading-up does not depart to any major extent from the desired quality as produced during normal operation and the time required to re-establish the leading end of the plug at the datum position will be very greatly reduced. When the yarn is then threaded up again and yarn tension re-established, its presence will provide a signal to restore full operation of the plug end sensor with consequent control of the parameter or parameters in question.

The predetermined change in the state of the yarn may amount to complete absence of the yarn, loss of yarn tension or loss of yarn movement Under normal operating condition, the leading end of the plug will most usually oscillate or "flutter" on either side of the datum position. In other words, as soon as the leading end moves to one side of the datum position, the controlling parameter will be adjusted in the appropriate direction to counteract this departure, but there will be a finite length of time before the effect is felt at the end of the plug and there will thus be a lag before the plug end is returned towards the datum position. In view of this time lag, there will be a very minor tendency towards over-compensation so that the plug end will then move slightly towards the other side of the datum position and again there will be a time lag before it moves back again. This hunting or fluttering movement is an inherent characteristic of a system of this type and, as a result, although there is a theoretical degree of bulk (referred to above as the predetermined degree of bulk) which will correspond precisely with the plug end being located at the datum position, in practice, owing to the fluttering movement, both the plug end position and the degree of bulk will constantly vary over a small range. Any reference to the "predetermined degree of bulk" must therefore be understood to include any bulk within this small range.

Under normal operating conditions with the plug end maintained at the datum position, the value of the controlling parameter may change during the course of time, because of, for example, changes in ambient temperature. Therefore, in the preferred arrangement, when a yarn break occurs, it is desirable that the second signal should operate to keep the controlling parameter or parameters at their value immediately prior to the loss of yarn and/or yarn tension or movement so that when re-threading is completed the controlling parameter or parameters will be at or close to the required level. However, it is also possible for the second signal to operate so as to establish the said parameter or parameters at a predetermined set value, e.g. a value corresponding to the plug end being at the datum position when setting up to operate the process. If that predetermined value, in practice equates with the value when the end breaks, the two modes of operation will produce the same result, but if, as referred to in the preferred construction, there is a difference in values of the said parameters the effect is to maintain the parameter or parameters at their effective value at that time. Nevertheless, since changes in the said parameter(s) during the course of time are normally slight, the second, less preferable, mode of operation also has positive advantages.

The preferred mode of operation may result either from the second signal replacing the first so that it takes over the control of the parameter in question or by the second signal operating to arrest or "freeze" the first signal so that control is maintained by the first signal at the arrested value.

As described originally, it is the temperature of the texturising jet which is most commonly used as the controlling parameter, but a similar result may be obtained by equivalent control of the temperature of the rollers, in particular those for stretching the yarn prior to the texturising jet and/or a heated plate or plates between the rollers and, if required, the temperatures of both the texturising jet and of the rollers and/or heated plate or plates may be adjusted in conjunction with one another to produce the necessary control effect.

Apparatus in accordance with the invention includes the normal components namely rollers for stretching the heated yarn, a texturising jet for crimping the yarn and forming the crimped yarn into an elongated plug, collecting means for guiding the plug along a predetermined path, means for monitoring the position of the leading end of the plug in relation to a datum position and for providing a first signal according to the direction of the displacement of the leading end from the datum position, means responsive to the first signal for controlling at least one of the parameters affecting the degree of crimp applied to the yarn to provide a predetermined degree of bulk preventing the leading end of the plug from departing from the datum position by more than a predetermined amount, a winder for receiving yarn withdrawn from the leading end of the crimp plug and guide means defining a path for the withdrawn yarn from the leading end of the crimp plug to the winder. In addition, in accordance with the invention the apparatus further comprises detecting means in the same yarn path which provides a second signal in response to a predetermined change in the state of the yarn, the second signal either replacing or arresting the first signal so as to keep the said parameter or parameters at a value corresponding to the predetermined degree of bulk.

The standard components of the apparatus may take any of the well known forms. In particular, the plug collecting means may be stationary, e.g. a collecting stack, but preferably it takes the form of a moving surface such as a conveyor or a rotating drum and the yarn withdrawn from the plug is made to engage at least a part of the moving surface so as to tension the yarn.

In one particular embodiment of the invention the extruded yarn is cooled, the spin finish applied, the yarn stretched and passed to a jet texturising chamber of a type such as described in British patent No. 1,342,484, the yarn being plasticised and projected through the crimp texturising chamber by means of pressurised heated fluid, e.g. air, which further impact crimps the plasticised yarn in a crimp plug former at the outlet end of the jet. The crimp plug is then guided in a crimp stack which is an extension of the plug former and delivered onto a rotating cooling drum around which it passes in plug form before the yarn is drawn off from the downstream end of the plug by a take-off roller from which it passes to a winder to be wound onto a package. Yarn guide members are positioned between the cooling drum and the winder and along that path a yarn detection device is positioned to detect the presence of the yarn by virtue of yarn tension variations.

BRIEF DESCRIPTION OF THE DRAWINGS

An example of apparatus operating in accordance with the invention in the general manner just referred to will now be described in more detail with reference to the accompanying drawings, in which.

DESCRIPTION OF THE PREFERRED EMBODIMENTS

Figure 1:
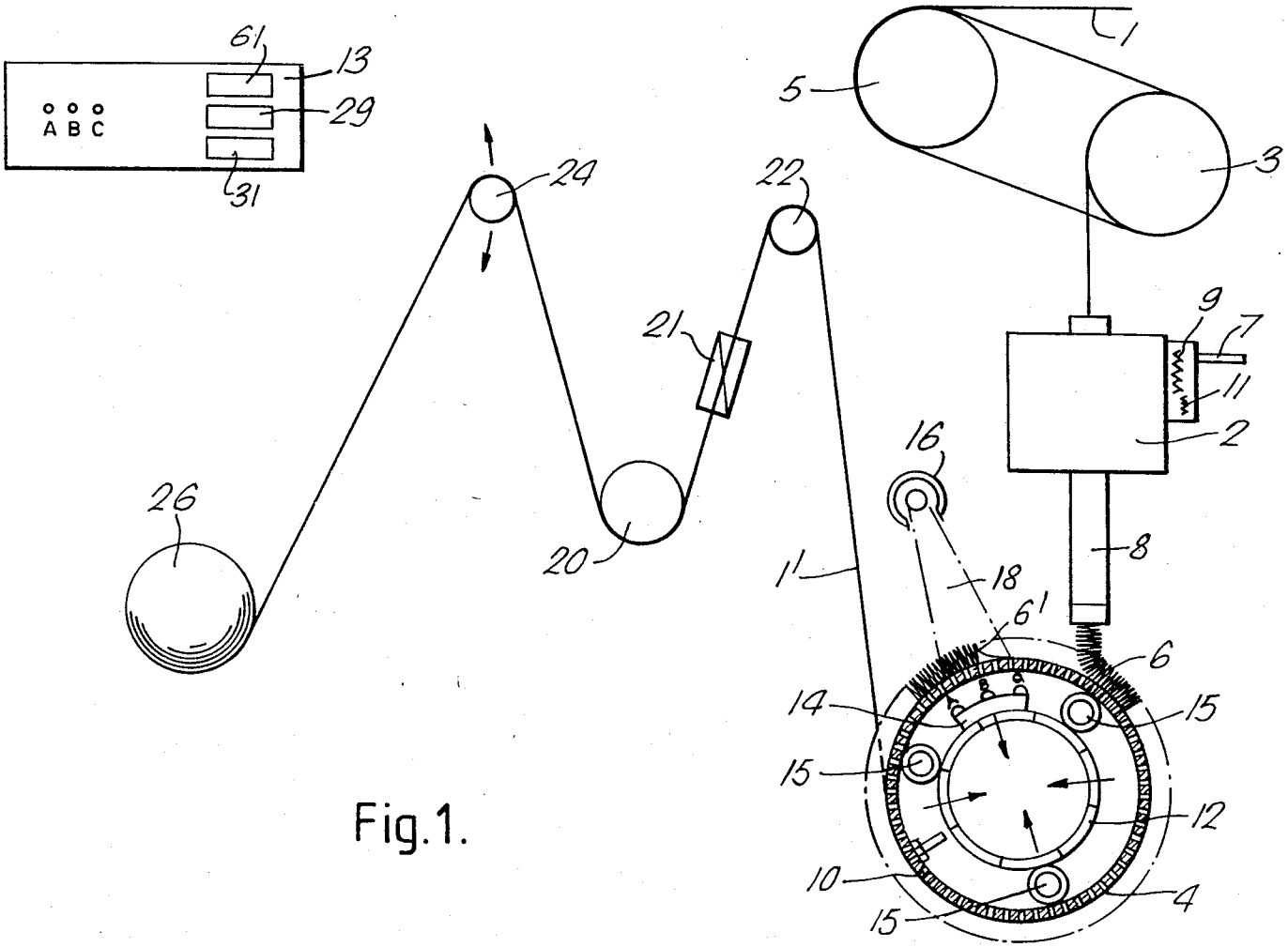
FIG. 1 is a semi-diagrammatic front elevation.
Figure 2:
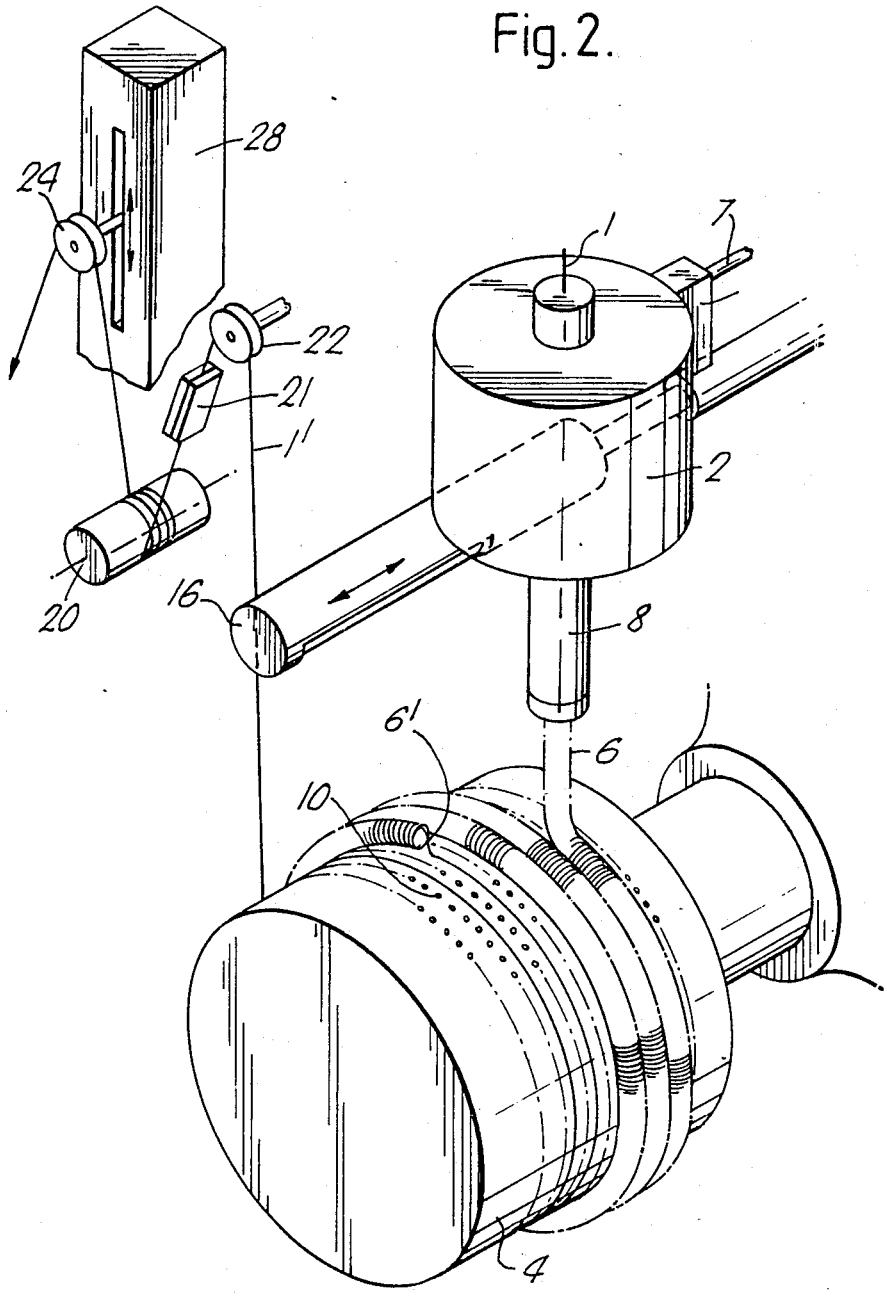
FIG. 2 is a perspective view corresponding to FIG. 1.

Turning first to FIGS. 1 and 2, yarn 1 from an extruder is first stretched by heated rollers 3, 5 and then passes to a jet texturiser unit 2 of which the details are not illustrated, but are basically similar to those in the British patent referred to above. In the unit 2 the yarn is plasticised to the required degree, propelled through the jet and crimped by the action of pressurised high velocity hot air. The air passes to the jet by way of a pipe 7 and is heated first by a base heating element 9 and subsequently by a booster element 11, the temperature to which the air is heated by the element 9 being set at a control panel 13 and remaining constant during operation unless changed by the operator. The air temperature downstream of the booster element 11 can also be set at the panel 13, the additional heat provided by the element 11 in combination with that provided by the base element 9 providing sufficient heat for the air to reach the temperature necessary to crimp the yarn to the desired bulk level.

The outlet end of the texturising jet is shaped as a plug former (not illustrated) into which the jet crimped yarn is projected to form a plug with further crimping as the yarn is impacted against the base of the plug. The plug is then guided in a stack shown diagrammatically at 8 from where it is delivered onto the surface of a rotating treatment drum 4 positioned below the stack 8 where it is cooled. In order to provide sufficient cooling the plug makes a number of turns around the drum 4 before the crimped yarn, shown as 1' is withdrawn from the drum at the leading end of the plug shown as 6'. It is the position of this leading end which is monitored to determine the regularity of the bulk yarn. If the bulk decreases, the length of the plug will increase, indicating the need for more crimp; if the bulk increases, the length of the plug will decrease, indicating the need for less crimp.

The plug length is monitored by a light sensor unit which has a receiver 14 mounted on a stationary suction tube 12 within the cooler drum 4, the drum also being mounted for rotation on bearings 15 on the suction tube. Ambient air is drawn into this tube through holes 10 around the circumference of the drum, hence cooling the plug. The array of holes 10 extends over a length of the drum sufficient to accommodate the maximum number of turns around the drum that it will be required to make with the plug. The light receiver has three spaced photo diodes A, B, C, the centre one B representing the datum position about which the leading end of the crimp plug will flutter if the bulk level of the texturised yarn is at the predetermined level. Illumination is provided by a beam 18 from a light source 16 mounted above the drum which shines through the holes in the drum.

In operation the plug end will flutter back and forth about the diode B, as previously described. When the diode is shaded from the beam by the plug it will signal a slight increase in heat requirement to booster element 11 and when the plug drops back to let the light through to the diode it will signal a slight reduction in heat to the booster element. Ideally it will flutter back and forth about the central diode position B. However, any changes in the yarn or processing parameters which causes a greater deviation of the plug end from this central position so that it falls back beyond diode A to uncover it to the light results in the heat output of the booster element being further reduced below its mean. Conversely if the plug end goes in the opposite direction to shade diode C from the light, which in effect is cutting the light from all three diodes, then the output from the booster element 11 will be increased so as to increase the overall heat applied to the yarn at the jet. The state of operation can be observed, at the control panel 13, on which there are three lamps A', B' and C' representing the corresponding diodes on the sensor receiver. These lamps light as the diodes are covered and the ideal situation indicating good regularity in the bulk level of the yarn is when bulb A is lit and B is quickly flashing on and off.

The yarn 6' from the drum 4 passes to a takeoff roller 20 via a further roller 22 and an intermingling jet 21 and the withdrawal tension on the bulked yarn as it passes from the drum to the roller 20 is largely dictated by the arc of contact which the yarn makes with the drum. In the illustrated construction it is shown as making approximately 270° around the drum. It is important to maintain this contact substantially constant otherwise it can affect intermingling downstream, hence the further importance of controlling the leading end of the plug in the datum position.

Figure 5:
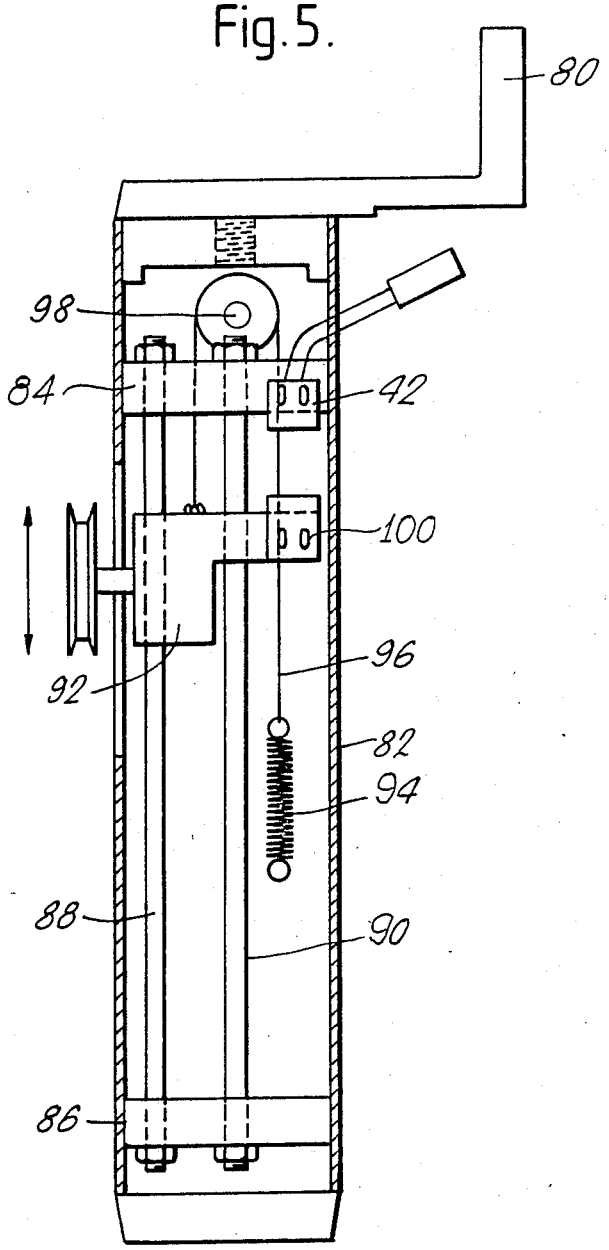
FIG. 5 is a sectional elevation of a yarn tension guide seen in FIGS. 1 and 2.

Tension variations can occur between the take-off roller 20 and the winder 26 and to compensate for such variations a spring loaded tension guide 24 (not shown in FIG. 2 but illustrated in detail in FIG. 5) is provided in the yarn path upstream of the winder 26. This tension guide will be pulled downward if the yarn tension increases and move upwards if it decreases. In the construction illustrated it also serves as the yarn sensor for detecting the presence of the yarn, and in the event of an end break it will move upwardly to a position to provide a signal from an electrical unit 28 that will replace the signal from the light sensor unit 14, 16, as described in more detail later. Details of the tension guide assembly are shown in FIG. 5. The assembly comprises a bracket 80 by which it is attached to the machine frame and a housing 82 mounted on the bracket. Bridging pieces 84, 86 are fitted at the top and bottom of the housing and slide rods 88, 90 extend between the two. The tension guide 24 is rotatably mounted on a slide bracket 92 which can slide along the slides and is biased upwardly by the pull of a spring 94 connected to the back wall of the housing and to the slide bracket by means of a cord 96 which passes around a pulley 98 at the top of the housing.

When the yarn breaks, resulting in a loss in yarn tension, the slide bracket 92 moves upwardly so as to cause magnetic actuator 100 on the slide bracket to operate a reed switch 42 on bridge piece 84, thus providing the signal replacing that from the sensor unit 14, 16.

The control panel has a V.D.U. 29 and by operating the appropriate buttons it is possible to display various processing parameters on the screen, e.g. temperature of jet, power ratings of the elements, roller and winding speeds and so forth. In order to facilitate threading up the yarn the light source 16 can be so mounted as to enable it to be withdrawn from its operative position over the drum to a position clear of the drum as is illustrated in FIG. 2 by arrows.

The radial position of the plug end sensor unit 14, 16 can be adjusted together or independently both radially and longitudinally of the drum axis to suit different yarn characteristics and to position the receiver 14 in line with the last turn of the plug around the drum. In order to avoid the holes in the drum becoming blocked or restricted and hence reducing the efficiency of the light beam 18, it may be desirable to fill some of the holes with a transparent resin but naturally this must not be done to the extent that it would adversely affect the suction cooling function of the drum.

The receiver 14 need not necessarily be positioned within the drum. The reverse could apply, i.e. with the light source within the drum and the receiver outside it, but with certain colours this might give rise to reflection problems and false signals unless shielded from such reflections. Alternatively both light source and receiver may be positioned on the same side of the drum and its surface polished, or reflector strips provided to reflect the light beam back to the receiver. It is, of course, not necessary to use light sensors, for example, sonic sensors could be used instead. Furthermore, whichever are used, additional diodes or their equivalent may be implemented, if desired to give a wider range of signals and, if necessary, additional light sources incorporated.

If desired a further yarn detector can be positioned upstream of the jet texturiser to act in the same manner as the yarn tension guide 24 when the yarn breaks upstream, but because of the speed of the process, this is not usually necessary as adequate control is derived from the downstream detector unit alone.

Figure 3:
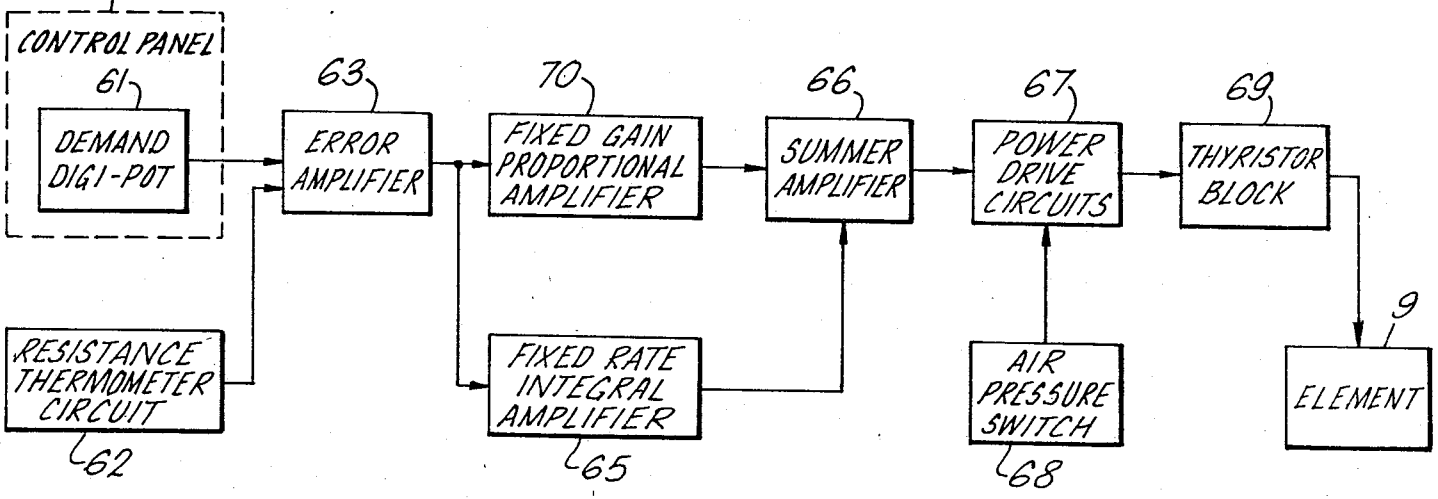
FIG. 3 is a circuit diagram of a temperature control system for a base heating element for the texturising jet.

FIG. 3 illustrates details of the control circuit for the base heater element 9 to which power is supplied by a thyristor block 69. As already described, the temperature of the element 9 is set by the operator at the start of operation and the temperature which is actually set is the air temperature immediately downstream of the element 9 and upstream of the booster heating element 11. This temperature is set at a digital potentiometer 61 on the control panel 13. The temperature of the air-stream as heated by the element 9 is monitored by a resistance thermometer circuit 62 which generates an electrical signal corresponding to this temperature. The signals from the digital potentiometer 61 and resistance thermometer circuit 62 are fed to an error amplifier 63, the magnitude and polarity of the difference between the two input signals determining the magnitude and polarity of the output voltage of this amplifier.

The output of the error amplifier 63 is fed to a fixed gain proportional amplifier 70 and fixed rate integral amplifier 65. The magnitude and polarity of the output of the former depends on and is proportional to the magnitude and polarity of the input from the error amplifier 63 and the output of the latter increases or decreases linearly depending on the polarity of the input from the error amplifier 63. The rate of increase/decrease is constant for a fixed input voltage, but as the magnitude of the input from the error amplifier 63 increases, the rate of increase/decrease increases and vice versa. If the input from the error amplifier 63 is zero the output from the fixed rate integral amplifier 65 remains constant.

A summer amplifier 66 combines the input signals from the fixed gain proportional amplifier 70 and fixed rate integral amplifier 65 and the magnitude of its output depends on the sum of the input signals. This output is fed to power drive circuits 67 which provide firing pulses to the thyristor block 69 which, as mentioned above, supplies electrical power to the element 9. A pressure switch 68 also acts on the power drive circuit 67 in such a way that when air pressure is present at the element 9 the power drive circuits 67 are enabled; should the air pressure at the element 9 fail then the power drive circuits 67 are disabled.

Figure 4:
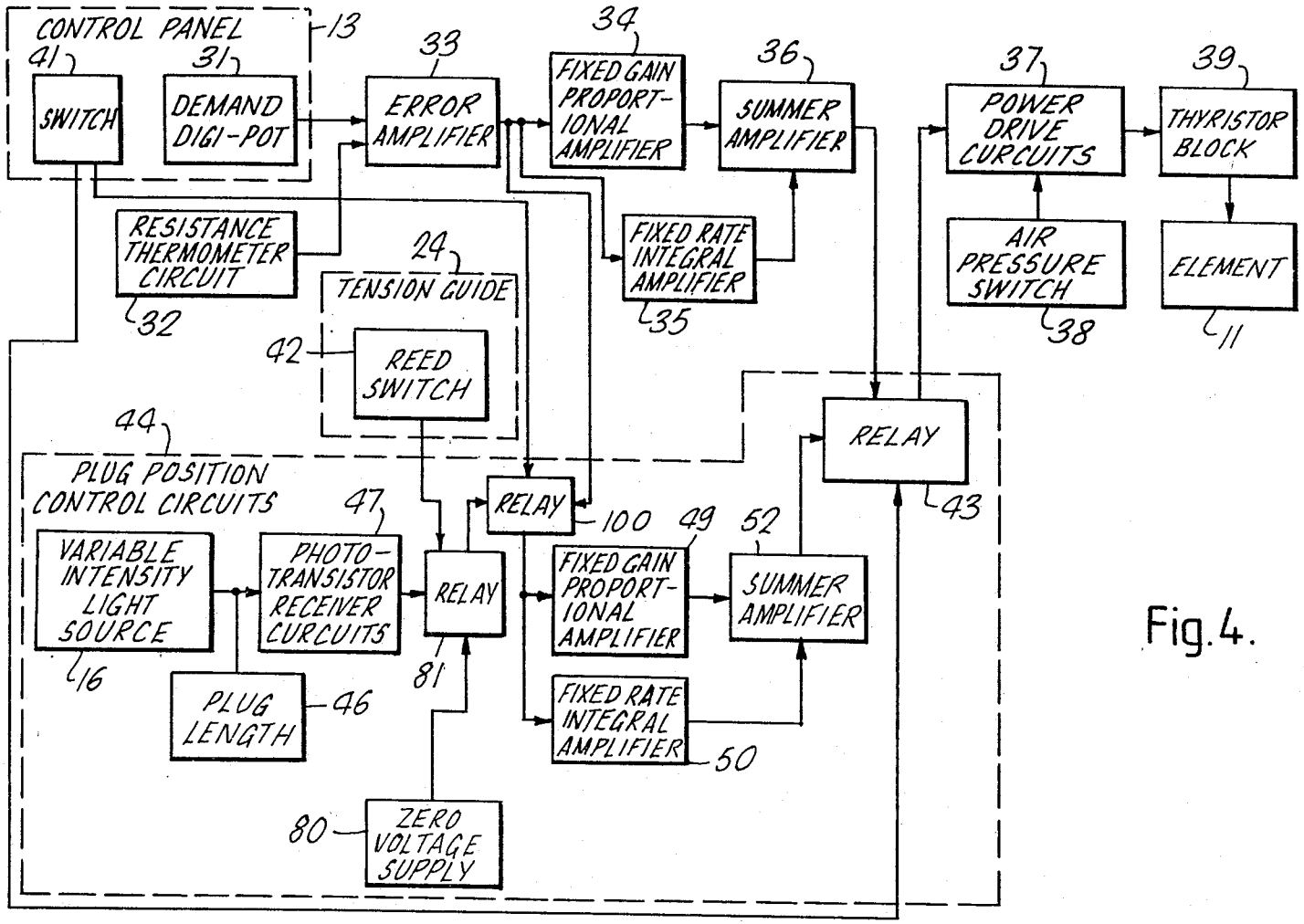
FIG. 4 is a circuit diagram of the control system for a booster heating element for the jet.

Control of the booster heater element 11 is illustrated in FIG. 4 and the system can be made to operate in either of two modes, referred to as the "stand-by" and "run" modes, the mode being determined by a switch 41 on the control panel 13 as it operates on a relay 43.

In the "stand-by" mode, which is normally selected when setting up the line to operate the process, the temperature of the air downstream of the element 11 is controlled in an analagous manner to that of the air immediately downstream of the base element 9, using similar circuitry, but with the necessary inclusion of, and via, the relay 43 using a digital potentiometer 31 on control panel 13. The purpose of the "stand-by" facility is so that the predetermined mean temperature can be set manually prior to switching to the "run" mode. Switch 41, in addition to operating on relay 43, also operates on a relay 100 which, in the "stand-by" mode, feeds the output voltage signal from error amplifier 33 to fixed gain proportional amplifier 49 and fixed rate integral amplifier 50 in the plug position control circuits 44. This means that in "stand-by" mode the said latter amplifiers respond in the safe manner as amplifiers 34 and 35 and produce identical outputs. When switching from the "stand-by" to the "run" mode (switch 41 in the "run" position). The operative input to relay 43 changes from summer amplifier 36 to summer amplifier 52 and simultaneously the operative input to relay 100 changes from error amplifier 33 to relay 81. In so doing, the power supplied to the booster heating element 11 is controlled by the plug position control circuits 44, i.e. the sensor-linked system, (provided the reed switch 42 in the yarn tension guide 24 is not activated), and is fed to the element via power drive circuits 37, and thyristor block 39. A pressure switch 38 also acts on the power drive circuits 37 in such a way that when air pressure is present at the element 11 the power drive circuits 37 are enabled. Should air pressure at the element 11 fail then the power drive circuits 37 are disabled. Since the initial outputs from amplifiers 49, 50 will be identical with those from amplifiers 34, 35 immediately subsequent to switching from "stand-by" to "run", a smooth transition will occur as plug position control becomes automatically effected by utilisation of the sensor linked system.

When the system is in the "run" mode the plug position control circuits 44 operate as follows:

The length of the plug (i.e. the position of the leading end of the plug) is detected by light receiver circuits 47 with light from the light source 16. As the plug length 46 increases the light falling on the three spaced photo diodes A, B, and C of the light receiver circuits 47 are observed in order A, B, C, providing four output voltage levels, i.e. no photo diodes, or one, two or three photo diodes illuminated. If no photo diode or one photo diode is covered the output voltage has a certain polarity. The polarity of the output voltage is reversed if two photo diodes or three photo diodes are covered. The absolute value of the output voltage is greater at the times when no photo diode or three photo diodes is or are covered than when one or two photo diode(s) is or are covered. The datum position of the plug end is directly above the photo diode B.

The signal from light receiver circuits 47 is fed to a fixed gain proportional amplifier 49 and fixed gain integral amplifier 50. The polarity and magnitude of the output of the fixed gain proportional amplifier 49 depend on the polarity of the input signal and the magnitude of the input signal. The output of the fixed rate integral amplifier 50 increases or decreases linearly depending on the polarity of the input from the light receiver circuits 47.

The rate of increase/decrease of the output of fixed rate integral amplifier 50 depends on the magnitude of the input voltage. If the input from the light receiver circuits 47 was to equal zero the output from fixed rate integral amplifier 50 would remain constant. When plug end position control at the datum position is effected, the input to fixed rate integral amplifier 50 and fixed gain proportional amplifier 49 fluctuates from positive to negative polarity at equal absolute values as the plug flutters back and forth about the diode B.

A summer amplifier 52 combines the input signals from fixed gain proportional amplifier 49 and fixed rate integral amplifier 50 and the magnitude of its output depends on the sum of the input signals. This output is passed to the power drive circuits 37 via the relay 43.

In the preferred mode of operation, when the control system is in the "run" mode and reed switch 42 is activated (viz when a yarn break occurs either upstream or downstream of the texturising jet) a zero voltage signal is fed to fixed gain proportional amplifier 49 and fixed rate integral amplifier 50 from a zero voltage supply 80 via relay 81, this signal replacing the prior voltage signal from light receiver circuits 47. A constant output is then sent therefore, via the summer amplifier 52 and relay 43 to the power drive circuits 37, resulting in a constant electrical power supply to the booster heater element 11. This is because with a zero input to the fixed rate integral amplifier 50 its output remains constant and has a value equal to that immediately prior to its input voltage level becoming zero, and because the output of the fixed gain proportional amplifier 49, whilst also constant, will be zero.

This mode of operation of the control system is particularly advantageous when, as sometimes happens, the temperature at which the plug end is maintained at the datum position as determined by the light receiver circuits 47 changes during the course of time from the predetermined datum value, as set at the digital potentiometer 31 on control panel 41 when in the "stand-by" mode prior to switching to the "run" mode. Therefore when the yarn breaks, the temperature of the texturising medium is maintained at, or very near, the required level throughout the interval between the occurrence of the break and re-threading up, thus ensuring that yarn of correct bulk is produced immediately or substantially immediately subsequent to re-threading up.

Nevertheless, the alternative mode of operation whereby the temperature is adjusted to the predetermined set value has positive advantages over the modes of operation used in the past since the latter temperature normally differs only slightly from the temperature determined by the light receiver circuits and the change in the yarn quality is barely detectable. This alternative mode is effected by connecting the reed switch 42 in parallel with switch 41 on the control panel 13 and omitting zero voltage supply 80 and relay 81 from the plug position control circuits 44, supply from the light receiver circuits passing directly to the fixed gain proportional amplifier 49 and fixed rate integral amplifier 50.

In the foregoing example, the invention has been described as applied to an apparatus of a known type, e.g. as described in the patents referred to above. However, it will be understood that the invention is in no way limited to apparatus of this type of construction or apparatus using any particular type of texturising jet. As already mentioned, control can be maintained by variation of a number of different parameters, not necessarily the temperature of the texturising jet. Moreover, while the example illustrates the cooling drum and sensor as accommodating only one crimp plug, a number of such plugs could be treated on a single drum, each such plug being sensed independently of the others by respective sensing units. On the other hand, it is not essential to use a drum for the cooling and other forms of cooling arrangement may be used if desired.

I claim:

1. In a method of crimp texturising an extended yarn comprising the steps of first heating, stretching said yarn and passing it through a texturising jet, then forming the resultant crimped yarn into an elongated plug having a leading end and guiding said plug along a predetermined path, withdrawing crimped yarn from said leading end of said plug and winding it into a package, monitoring the position of said leading end of said plug in relation to a datum position along said path, to provide a signal according to the direction of the displacement of said leading end from said datum position, in order to control at least one of the parameters affecting the crimp applied to said yarn whereby to provide a predetermined degree of bulk, preventing said leading end of said plug from departing from said datum position by more than a predetermined amount, the improvement comprising monitoring the passage of yarn to said winding step to provide, in response to a predetermined change in the state of said yarn, a second signal which operates with respect to said first signal so as to maintain the temperature of the texturising jet at the value thereof immediately prior to the predetermined change in the state of the yarn in response to which the said second signal is provided.

2. In a method of crimp texturising an extruded yarn comprising the steps of heating and stretching said yarn and then passing the yarn through a texturising jet to provide crimping thereof, forming the resultant crimped yarn into an elongated plug having a leading end, guiding said plug along a predetermined path, withdrawing the crimped yarn from the leading end of the plug and winding the crimped yarn into a package, and monitoring the thus crimped yarn to provide a first signal indicative of the bulk level of the yarn so as to vary the temperature applied to the yarn to provide a predetermined degree of yarn bulk, the improvement comprising providing a second signal indicative of the passage of yarn which, in response to a yarn break, operates with respect to the first signal so as to maintain the temperature of the yarn at the value thereof immediately prior to the yarn break.

* * * * *